United States Patent [19]

Seynhaeve

[11] Patent Number: 4,610,333

[45] Date of Patent: Sep. 9, 1986

[54] FRAME FOR FLEXIBLE SUITCASE AND FLEXIBLE SUITCASE MAKING USE OF A FRAME OF THIS TYPE

[75] Inventor: André G. Seynhaeve, Senlis, France

[73] Assignee: Ste Delsey, Bobigny, France

[21] Appl. No.: 775,324

[22] Filed: Sep. 12, 1985

Related U.S. Application Data

[63] Continuation of Ser. No. 588,369, Mar. 12, 1984.

[30] Foreign Application Priority Data

Mar. 25, 1983 [FR] France ..... 83 04898

[51] Int. Cl.[4] ..... A45C 5/00

[52] U.S. Cl. ..... 190/18 A; 190/115; 190/122; 190/127

[58] Field of Search ..... 190/18 A, 115, 122, 190/123, 125, 126, 127; 220/94 R

[56] References Cited

U.S. PATENT DOCUMENTS 2,531,302 11/1950 Schwennicke ..... 190/127

3,592,314 7/1971 Jacobson ..... 190/122

*Primary Examiner*—Joseph Man-Fu Moy

*Assistant Examiner*—David Fidei

*Attorney, Agent, or Firm*—James C. Wray

[57] ABSTRACT

A frame for a flexible suitcase comprises a single closed moulding of substantially rectangular longitudinal section, having an upper edge, a lower edge and two side edges interconnecting said upper and lower edges. The moulding is manufactured in a single pressure moulding operation from a synthetic material and is provided with a groove open towards the outside. Accessory supports are moulded in one piece with the aforementioned moulding.

6 Claims, 14 Drawing Figures

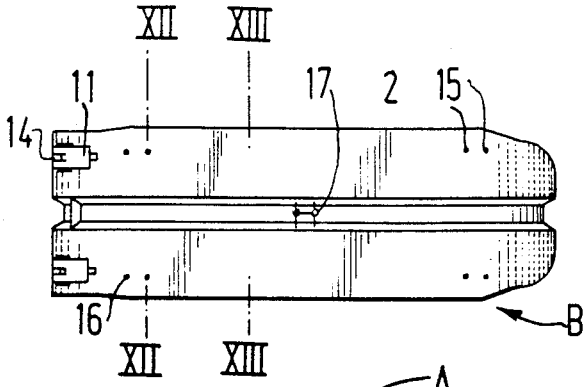
FIG.4
FIG.5
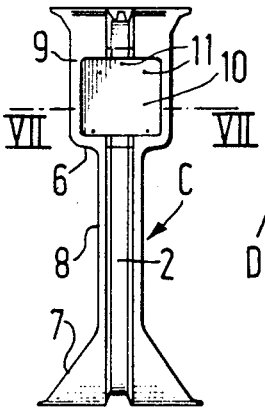
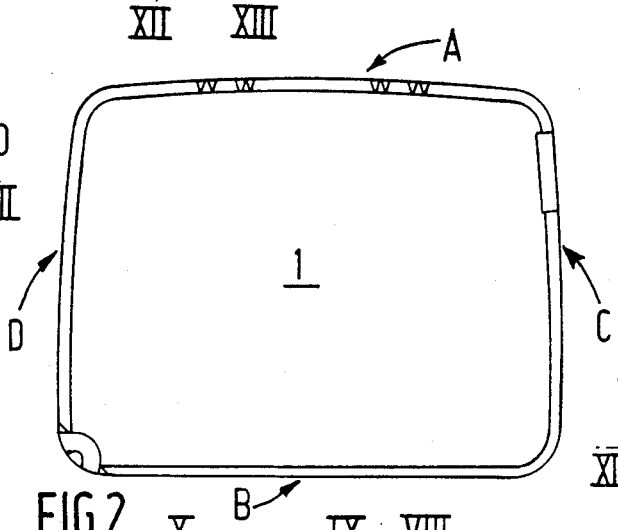
FIG.2
FIG.6
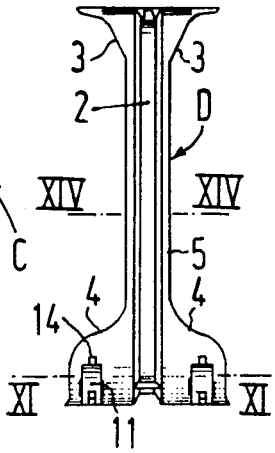
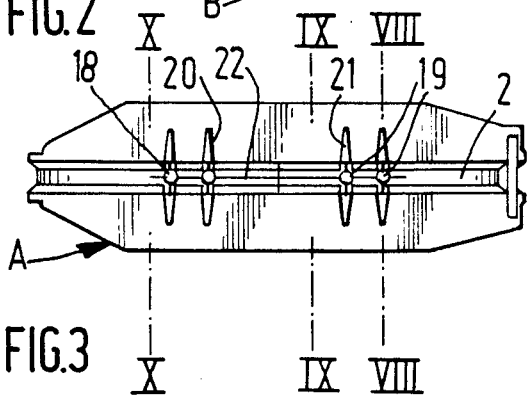
FIG.3

FRAME FOR FLEXIBLE SUITCASE AND FLEXIBLE SUITCASE MAKING USE OF A FRAME OF THIS TYPE

This application is a continuation, of application Ser. No. 588,369, filed Mar. 12, 1984.

BACKGROUND TO THE INVENTION

The present invention relates to a frame for a flexible suitcase and to flexible suitcases making use of a frame of this type.

STATEMENT OF PRIOR ART

The known flexible suitcases make use of a supporting frame over which is stretched a flexible cover of cloth, woven fabric, leather etc. The frames of these known suitcases are made of metal, such as steel, aluminium alloy, magnesium alloy, or plywood, cardboard, plastic etc. They are either made in sections or all in one piece and may include different materials connected to one another in various ways.

The non-continuous frames lack sufficient mechanical strength, while the manufacture of continuous frames involves assembly operations with the use of welding, adhesives or riveting, which are time-consuming and expensive and often produce weak connection points. In all cases the interior of the suitcase has to be lined in order to conceal the frame, as the manufacturing technique does not allow of a satisfactory finish. Furthermore, these articles of luggage are excessively heavy, and the operation of affixing accessories, such as wheels, handles or feet, is a very delicate one, involving re-treatment and thus creating further weak points.

OBJECT OF THE INVENTION

An object of the present invention is to enable these drawbacks of the known frames and flexible suitcases to be eliminated by means of new type of frame which is simple and economical to manufacture, offers high mechanical resistance, and enables the supports of the accessories to be integrated therein and at the same time facilitates the operation of mounting these accessories and the cover without necessitating any inner lining.

SUMMARY OF THE INVENTION

A one-piece injection moulded plastic suitcase frame or generally rectangular shape comprising (a) a relatively wide and substantially flat base portion, (b) two radiused lower corner portions at the end of the base portion, said corner portions being substantially the same width as the width of the base portion at the junctures with the base portion, at least one of said corner portions having said same width over a major portion of the length of the corner portion, (c) two relatively narrow opposite side flat portions connected to said corner portions respectively, (d) a relatively wide top portion having a width less than the base portion but wider than the side portions, (e) two radiused upper corner portions connected to the upper ends of the side portions respectively and to the ends of the top portion respectively, said corner portions being substantially the same width as the width of the top portion at the junctures with the top portion, at least one of said upper corner portions having a width substantially equal to the width of the top portion over a major portion of the length of the upper corner portion, and (f) a substantially continuous groove being provided on the outsides of the base portion, lower corner portions, said portions, top portion and upper corner portions, said groove being defined by a series of relatively narrow central strips of each of the above-mentioned portions, which strips are offset inwardly of said portions respectively thus defining a rib on the inside surfaces of said portions complementary to said groove.

By one single operation, a continuous single-piece frame is provided of which the mechanical strength can be determined by the characteristics of the moulded material, its thickness and the formation of stiffening devices, and which comprises supports for accessories without any reduction in its mechanical strength. The frame to which the invention relates can also be considerably reduced in weight, by comparison with the frames already known, due to the characteristics of the materials employed and to the shapes selected. The resulting suitcase is made still lighter in weight by the fact that the internal surface of the frame may have a highly satisfactory appearance and be given the desired colour, so that this internal surface does not have to be lined as in the case of the known types of suitcase. All these advantages are additionally reflected in a noticeable saving of material and labour.

BRIEF DESCRIPTION OF DRAWINGS

The invention will now be described by reference to the accompanying drawings:-

FIG. 2 is a front elevation of the frame shown in FIG. 1;

FIG. 3 is a view, from above, of the frame shown in FIGS. 1 and 2;

FIG. 4 is a view, from below, of the frame shown in FIGS. 1 and 3;

FIG. 5 is a side elevation of the frame shown in FIGS. 1–4;

FIG. 6 is another side elevation of the frame shown in FIGS. 1–4;

DESCRIPTION OF PREFERRED EMBODIMENTS

Figure 1:
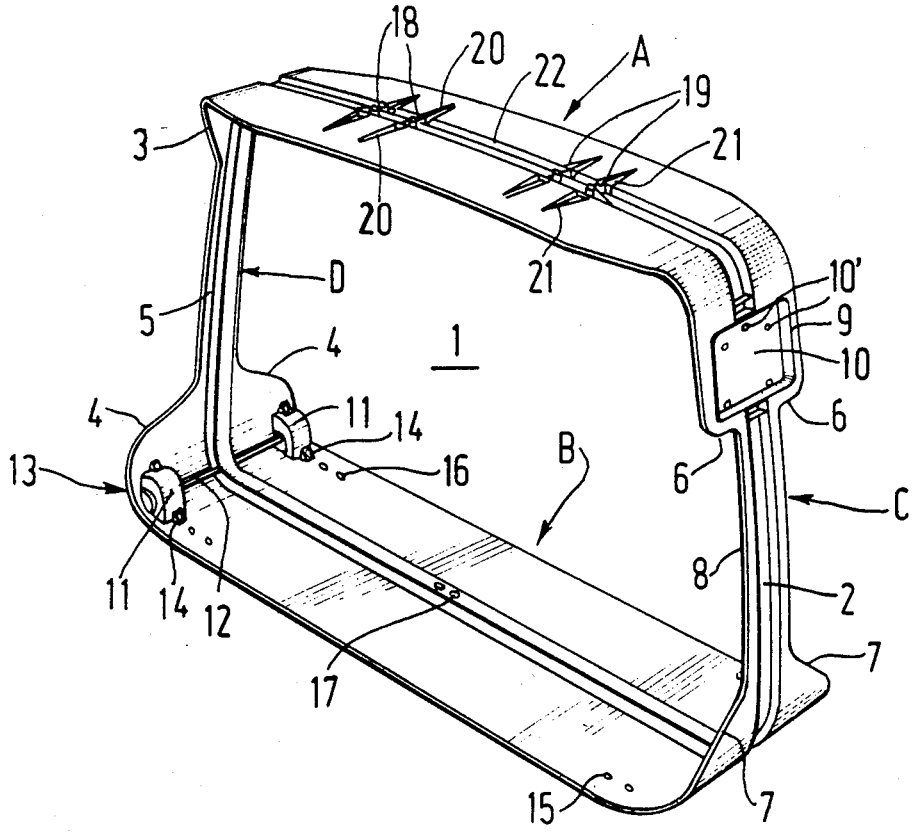
FIG. 1 is a schematic view, in perspective, of a frame according to one constructional example of the invention.
Figure 7:
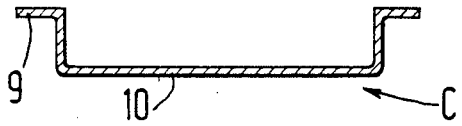
FIG. 7 is a partial section along the line VII—VII of FIG. 5.
Figure 8:
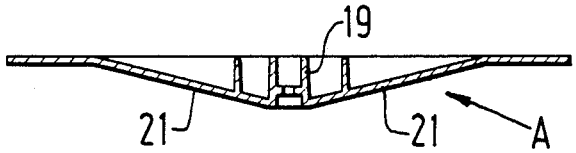
FIGS. 8, 9 and 10 are partial sections along the lines VIIII—VIIII, IX—IX and X—X respectively of FIG. 3.
Figure 9:
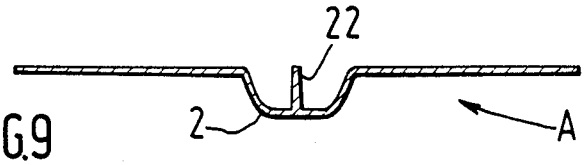
Figure 10:
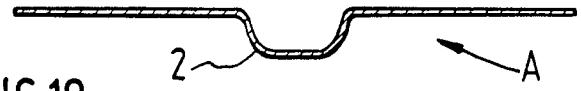
Figure 11:
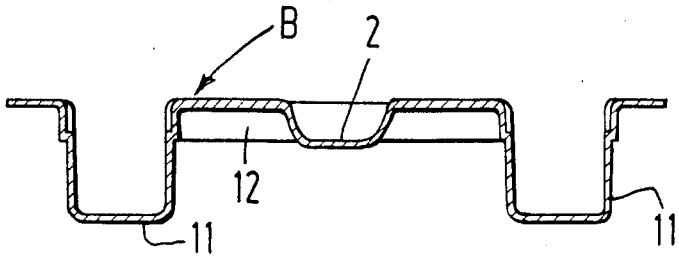
FIG. 11 is a partial section along the line XI—XI of FIG. 6.
Figure 12:
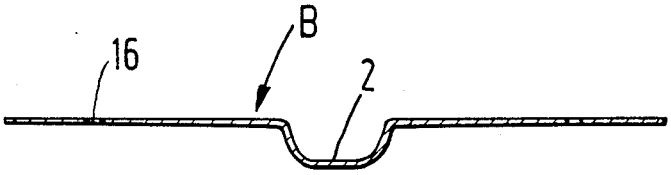
FIGS. 12 and 13 are partial sections along the lines XII—XII and XIII—XIII of FIG. 4.
Figure 13:
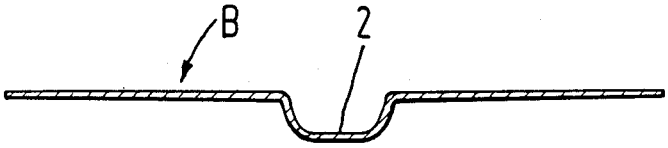
Figure 14:
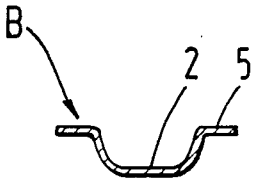
FIG. 14 is a partial section along the line XIV—XIV of FIG. 6.

The frame illustrated by way of an example without any limitative effect consists of one single pressure moulding from a synthetic material having good mechanical properties and also optimum weight and satisfactory moulding capacity, in addition to moderate cost. Examples of such materials are polyamides, polypropylenes and polyesters, whether or not provided with a charge.

The frame 1 has a substantially rectangular longitudinal section, forming an upper edge A and a lower edge B, interconnected by side edges C and D, these edges having a generally rectilinear cross section, with a continuous groove 2, whereby the frame is generally stiffened. The groove 2 in the example described is symmetrical in respect of a median plane which is likewise a plane of symmetry of the frame 1.

The side edge D has upper and lower projections 3 and 4 respectively, producing a contracted central strip 5 around the groove 2. Similarly, the side edge C has upper and lower projections 6 and 7 respectively, producing a contracted central strip 8 around the groove 2. The upper projections 6 of the edge C are nevertheless formed farther down than the upper projections 3 of the edge D, leaving a wider upper zone 9 on the said edge C. This zone 9 contains a hollowed-out portion 10 of a generally rectangular shape, its base being perforated with holes 10' as a means of affixing a handle, e.g. of the tilting type (not shown) accommodated in the hollowed-out portion 10. The various projections are rounded, in order to avoid producing points at which the frame 1 is likely to be broken.

The lower part of the side edge D is provided with two bushings 11 designed to accommodate rollers and interconnected by a stiffening rib 12. The rollers may be mounted direct or via supports secured in the bushings. The formation of the bushings 11 and of the rib 12 renders the connecting corner 13 between the edges D and B of the frame 1 extremely rigid, this corner 13 supporting the weight of the suitcase and of its contents when the suitcase is being drawn along with the use of the tilting handle. Sockets 14 serve to fix the rollers in position.

The lower edge B of the frame is provided with pairs of holes 15 and 16 respectively symmetrical in relation to the plane of symmetry and serving to secure feet. Supplementary holes 17 may be provided, for example, in the base of the groove 2, as an additional means of securing the cover, which will already be connected to the frame 1 by the various accessories affixed.

The upper edge A is provided with pairs of sockets 18 and 19 designed to accommodate screws or rivets serving to affix a handle. The sockets 18 and 19 formed in the groove 2 are surrounded transversally by stiffening ribs 20 and 21 respectively and are interconnected by a central rib 22, the assembly ensuring excellent mechanical strength when the suitcase is held by its handle.

I claim:

1. A one-piece injection moulded plastic suitcase frame of generally rectangular shape comprising (a) a relatively wide and substantially flat base portion, (b) two radiused lower corner portions at the ends of the base portion, said corner portions being of substantially the same width as the width of the base portion at the junctures with the base portion, one of said corner portions having said same width over a major portion of the length of the corner portion and having bushings provided on opposite sides thereof, said bushings being integrally formed with the frame and having a transverse rib extending therebetween, said bushings and rib providing means to rigidify the corner for the purpose of supporting the weight of the suitcase, (c) two relatively narrow opposite said flat portions connected to said corner portions respectively, (d) a relatively wide top portion having a width less than the base portion but wider than the side portions, (e) two radiused upper corner portions connected to the upper ends of the side portions respectively and to the ends of the top portion respectively, said corner portions being substantially the same width as the width of the top portion at the junctures with the top portion, at least one of said upper corner portions having a width substantially equal to the width of the top portion over a major portion of the length of the upper corner portion, and (f) a substantially continuous groove being provided on the outsides of the base portion, lower corner portions, side portions, top portion and upper corner portions, said groove being defined by a relatively narrow central strip offset inwardly of each of said top, base, side, upper and lower corner portions thus defining a rib on the inside surfaces of said portions complementary to said groove.

2. A one-piece injection moulded plastic suitcase frame of generally rectangular shape comprising (a) a relatively wide and substantially flat base portion, (b) two radiused lower corner portions at the ends of the base portion, said corner portions being substantially the same width as the width of the base portion at the junctures with the base portion, at least one of said corner portions having said same width over a major portion the length of the corner portion, (c) two relatively narrow opposite side flat portions connected to said corner portions respectively, (d) a relatively wide top portion having a width less than the base portion but wider than the side portions, (e) two radiused upper corner portions connected to the upper ends of the side portions respectively and to the ends of the top portion respectively, said corner portions being substantially the same width as the width of the top portion at the junctures with the top portion, at lest one of said upper corner portions having a width substantially equal to the width of the top portion over a major portion of the length of the upper corner portion, (f) one of the upper corner portions extends further downwardly then the other upper corner portion providing a wide upper zone for the corresponding side portion, the wide upper zone being provided with a rectangular recess fir receiving a handle mounting, and the diagonally opposite lower corner portion being provided internally with integrally formed bushings which are open externally to accommodate rollers, and (g) a substantially continuous groove being provided on the outsides of the base portion, lower corner portions, side portions, top portion and upper corner portions, said groove being defined by a relatively narrow central strip offset inwardly of each of said top, base, side upper and lower corner portions thus defining a rib on the inside surface of said portions complementary to said groove, said groove merging with said recess.

3. A frame in accordance with claim 1, which is symmetrical in relation to the longitudinal median plane of the said groove.

4. A frame in accordance with claim 2, wherein sockets are moulded in the upper edge of the said groove.

5. A frame in accordance with claim 4, wherein stiffening ribs are provided in the said groove.

6. A frame in accordance with claim 5, wherein said bushings are interconnected by a transverse rib.

* * * * *

UNITED STATES PATENT OFFICE

CERTIFICATE OF CORRECTION

Patent No. 4,610,333 Dated September 9, 1986

Inventor(s) Andre Seynhaeve

It is certified that error appears in the above-identified patent and that said Letters Patent are hereby corrected as shown below:

Column 4, line 38, change "lest" to --least--;

Signed and Sealed this

Sixteenth Day of December, 1986

*Attest:*

DONALD J. QUIGG

*Attesting Officer* *Commissioner of Patents and Trademarks*